US008806886B2

(12) United States Patent
Rafalovich et al.

(10) Patent No.: US 8,806,886 B2
(45) Date of Patent: Aug. 19, 2014

(54) TEMPERATURE CONTROLLED DEVICES

(75) Inventors: Alexander Pinkus Rafalovich, Louisville, KY (US); Martin Mitchell Zentner, Prospect, KY (US); Timothy Allen Hamel, Louisville, KY (US); Toby Whitaker, Loveland, CO (US)

(73) Assignee: General Electric Company, Schenectady, NY (US)

( * ) Notice: Subject to any disclaimer, the term of this patent is extended or adjusted under 35 U.S.C. 154(b) by 321 days.

(21) Appl. No.: 11/960,956

(22) Filed: Dec. 20, 2007

(65) Prior Publication Data

US 2009/0158768 A1 Jun. 25, 2009

(51) Int. Cl.
*F25D 17/02* (2006.01)
*F25D 11/02* (2006.01)

(52) U.S. Cl.
CPC ..... *F25D 11/025* (2013.01)
USPC ..... 62/434; 62/440

(58) Field of Classification Search
USPC ..... 62/434–435, 440–441, 238.1
See application file for complete search history.

(56) References Cited

U.S. PATENT DOCUMENTS

| | | | | |
|---|---|---|---|---|
| 1,962,580 | A | | 6/1934 | Carpenter |
| 1,992,018 | A | | 2/1935 | Steenstrup et al. |
| 2,120,185 | A | | 6/1938 | Phillip |
| 2,128,794 | A | | 8/1938 | Billings |
| 2,287,255 | A | | 6/1942 | Langgaard |
| 2,503,922 | A | | 4/1950 | Schmacher |
| 2,514,301 | A | | 7/1950 | Tenney |
| 2,942,432 | A | | 6/1960 | Muffly |
| 3,788,089 | A | | 1/1974 | Graves |
| 4,280,335 | A | * | 7/1981 | Perez et al. ..... 62/332 |
| 4,344,298 | A | | 8/1982 | Biemiller |
| 4,444,223 | A | * | 4/1984 | Maldavs ..... 137/614.04 |
| 4,907,417 | A | | 3/1990 | Forsythe |
| 4,942,742 | A | | 7/1990 | Burruel |
| 4,984,435 | A | | 1/1991 | Seino et al. |
| 5,005,379 | A | * | 4/1991 | Brown ..... 62/434 |
| 5,307,642 | A | | 5/1994 | Dean |
| 5,327,736 | A | | 7/1994 | Hino |
| 5,406,805 | A | | 4/1995 | Radermacher et al. |
| 5,743,109 | A | * | 4/1998 | Schulak ..... 62/428 |
| 5,755,104 | A | * | 5/1998 | Rafalovich et al. ..... 62/81 |

(Continued)

OTHER PUBLICATIONS

Notice of references to related case U.S. Appl. No. 11/958,900, Sep. 16, 2010.

(Continued)

*Primary Examiner* — Mohammad M Ali
*Assistant Examiner* — Daniel C Comings
(74) *Attorney, Agent, or Firm* — GE Global Patent Operation; Douglas Zhang

(57) ABSTRACT

A temperature controlled surface in a refrigerator that includes a heat exchanger configured to have the cooling medium flow therethrough to be cooled in thermal communication with a freezer compartment of the refrigerator. A second heat exchanger disposed downstream of the first heat exchanger and configured to have the cooling medium flow therethrough to cool the temperature controlled surface. A pump configured to flow the cooling medium through the first and second heat exchangers. A first heat exchanger is disposed downstream of the storage tank and is configured to have the cooling medium flow therethrough to be cooled. A second heat exchanger is disposed downstream of the first heat exchanger and is configured to have the cooling medium flow therethrough to cool the air and any contents within the temperature controlled compartment.

20 Claims, 3 Drawing Sheets

(56) References Cited

U.S. PATENT DOCUMENTS

| | | | | |
|---|---|---|---|---|
| 5,964,101 | A * | 10/1999 | Schulak et al. | 62/430 |
| 6,148,634 | A * | 11/2000 | Sherwood | 62/434 |
| 6,205,795 | B1 | 3/2001 | Backman et al. | |
| 6,216,469 | B1 | 4/2001 | Miller | |
| 6,253,563 | B1 | 7/2001 | Ewert et al. | |
| 6,293,107 | B1 | 9/2001 | Kitagawa et al. | |
| 6,467,279 | B1 | 10/2002 | Backman et al. | |
| 6,474,093 | B1 | 11/2002 | Fink et al. | |
| 6,588,219 | B2 | 7/2003 | Zevlakis | |
| 6,655,170 | B2 | 12/2003 | Holz et al. | |
| 6,973,799 | B2 | 12/2005 | Kuehl et al. | |
| 7,051,543 | B2 * | 5/2006 | Trujillo et al. | 62/201 |
| 7,181,921 | B2 | 2/2007 | Nuiding | |
| 7,190,583 | B1 | 3/2007 | Fendley et al. | |
| 7,216,494 | B2 * | 5/2007 | Thurman | 62/84 |
| 7,216,499 | B2 | 5/2007 | Flinner et al. | |
| 7,322,204 | B2 | 1/2008 | Hirao et al. | |
| 7,610,773 | B2 | 11/2009 | Rafalovich et al. | |
| 2002/0088242 | A1 * | 7/2002 | Williams | 62/259.2 |
| 2004/0031280 | A1 | 2/2004 | Martin et al. | |
| 2004/0237565 | A1 | 12/2004 | Lee et al. | |
| 2004/0244396 | A1 * | 12/2004 | Lane et al. | 62/246 |
| 2005/0223730 | A1 | 10/2005 | Kester et al. | |
| 2006/0037329 | A1 | 2/2006 | Narayanamurthy | |
| 2006/0144053 | A1 * | 7/2006 | Zhang et al. | 62/6 |
| 2007/0101761 | A1 * | 5/2007 | Yanik et al. | 62/515 |
| 2007/0137241 | A1 | 6/2007 | Lee et al. | |
| 2008/0141699 | A1 * | 6/2008 | Rafalovich et al. | 62/340 |
| 2008/0148761 | A1 | 6/2008 | Venkatakrishnan et al. | |
| 2008/0156009 | A1 | 7/2008 | Cur et al. | |
| 2008/0156022 | A1 | 7/2008 | LeClear et al. | |
| 2009/0151375 | A1 | 6/2009 | Tarr et al. | |

OTHER PUBLICATIONS

U.S. Appl. No. 11/610,798, filed Dec. 14, 2006, Rafalovich et al.
U.S. Appl. No. 12/508,253, filed Jul. 23, 2009, Rafalovich et al.
U.S. Appl. No. 11/958,900, filed Feb. 18, 2007, Tarr et al.
U.S. Appl. No. 11/967,681, filed Dec. 31, 2007, Rafalovich et al.

* cited by examiner

TEMPERATURE CONTROLLED DEVICES

BACKGROUND OF THE INVENTION

This invention relates generally to temperature-controlled devices, and more particularly, to temperature controlled devices utilizing a secondary cooling loop from a primary cooling source.

It is generally known to provide refrigeration systems for commercial or institutional food sales or food service facilities such as supermarkets, grocery stores, cafeterias, etc. These refrigeration systems operate with refrigeration or cooling devices such as temperature controlled cases (individually or in groups) that use air-cooled or water-cooled condensers supplied by a rack of compressors. For example, modern supermarket applications typically have many individual or grouped refrigeration devices located throughout the shopping or display area of the supermarket. Each refrigeration device is provided with a cooling interface such as an evaporator or cooling coil that receives refrigerant from the refrigeration system in a closed loop configuration where the refrigerant is expanded to a low pressure and temperature state for circulation through the cooling interface to cool the space and objects within the refrigeration device. In such applications, one or more condensers are typically located either outside, on the roof, or in a machine room or back room adjacent to the shopping or display area where the refrigeration devices are located and are used to cool the refrigerant that is distributed to all or a group of these refrigeration devices.

Similarly, there has become a proliferation of refrigeration devices in use in residential applications. These devices can include but are not limited to several refrigerators with icemakers, ice machines, freezers, wine chillers and can coolers. Typically, each of these devices utilizes a self-contained evaporator/condenser cooling circuit. These evaporator/condenser circuits, while capable of high capacity and are efficient, they are expensive to manufacture and maintain. The devices requiring cooling may use other forms of heat exchange such as thermoelectric cooling. However, thermoelectric cooling has low efficiency, low capacity, and a high thermal inertia.

While evaporator/condenser cooling circuits are generally an efficient cooling means, the system is driven by a refrigeration compressor system. The compressor utilizes electricity through a pump to compress a refrigerant. Each compressor occupies space and can be a source of noise. The refrigerant is cooled in a coil exposed to the ambient air of the residence or other location of the circuit. The refrigerant is then depressurized reducing the temperature of the refrigerant. The reduced temperature refrigerant is used in a heat exchanger within the device to be cooled to reduce the temperature. Each of these stages has inefficiencies in the form of heat or electrical consumption.

Accordingly, it would be advantageous to provide a distributed refrigeration system having a stand-alone refrigeration device with a self-contained refrigeration system that is suitably efficient for residential viability. It would be further advantageous to provide a distributed refrigeration system having a sufficiently low noise level. It would also be advantageous to provide a distributed refrigeration system that reduces the amount of refrigerant or evaporative/condenser systems thus reducing potential environmental hazards. It would also be advantageous to provide a distributed refrigeration system permitting the connection of devices thereto and having applications that are not possible where an individual refrigeration circuit would be required. It would be further advantageous to provide a distributed refrigeration system having a central electrical unit in which all electrical functions of the distributed refrigeration unit are pre-wired at the factory and require only a single electrical power hook up when installed in a home.

Accordingly, it would be advantageous to provide a distributed refrigeration system having any one or more of these or other advantageous features.

BRIEF DESCRIPTION OF THE INVENTION

In one aspect, a refrigerator is provided. A temperature controlled compartment in a refrigerator that includes a heat exchanger configured to have the cooling medium flow therethrough to be cooled in thermal communication with a freezer compartment of the refrigerator. A second heat exchanger disposed downstream of the first heat exchanger and configured to have the cooling medium flow therethrough to cool the temperature-controlled compartment. A pump configured to flow the cooling medium through the first and second heat exchangers. A first heat exchanger is disposed downstream of the storage tank and is configured to have the cooling medium flow therethrough to be cooled. A second heat exchanger is disposed downstream of the first heat exchanger and is configured to have the cooling medium flow therethrough to cool the air and any contents within the temperature controlled compartment.

In another aspect of the invention, a method is used for a chilled compartment in a refrigerator. First, flowing a refrigerant through a cooling system to cool a first interior compartment of the refrigerator. Then, flowing a cooling medium different from the refrigerant through a first heat exchanger disposed within the first interior compartment to decrease the temperature of the cooling medium. Finally, flowing the cooling medium through a second heat exchanger in thermal communication with the chilled compartment to reduce the temperature of the chilled compartment.

In yet another aspect of the invention, a refrigerator having a compartment cooling section configured to cool an interior compartment of the refrigerator. The compartment cooling section has a first heat exchanger configured to have a refrigerant flow through it to absorb heat. An ice producing apparatus is configured to produce ice and to deliver the ice through an opening in a door of the refrigerator. The ice producing apparatus has a storage tank configured to store a cooling medium. It also has a second heat exchanger disposed downstream of the storage tank that is configured to have the cooling medium flow through it to be cooled. An ice mold with at least one cavity that is configured to retain water therein is in thermal communication with a third heat exchanger that is disposed downstream of the second heat exchanger and configured to have the cooling medium flow through it to freeze the water in the ice mold to produce ice.

DETAILED DESCRIPTION OF THE INVENTION

It is contemplated that the teaching of the description set forth below is applicable to all types of refrigeration appliances, including but not limited to refrigerators but include a standalone refrigeration unit or may be connected to an air conditioning unit. The present invention is therefore not intended to be limited to any particular refrigeration device or configuration of cooling circuit 100 for the temperature controlled medium.

Figure 1:
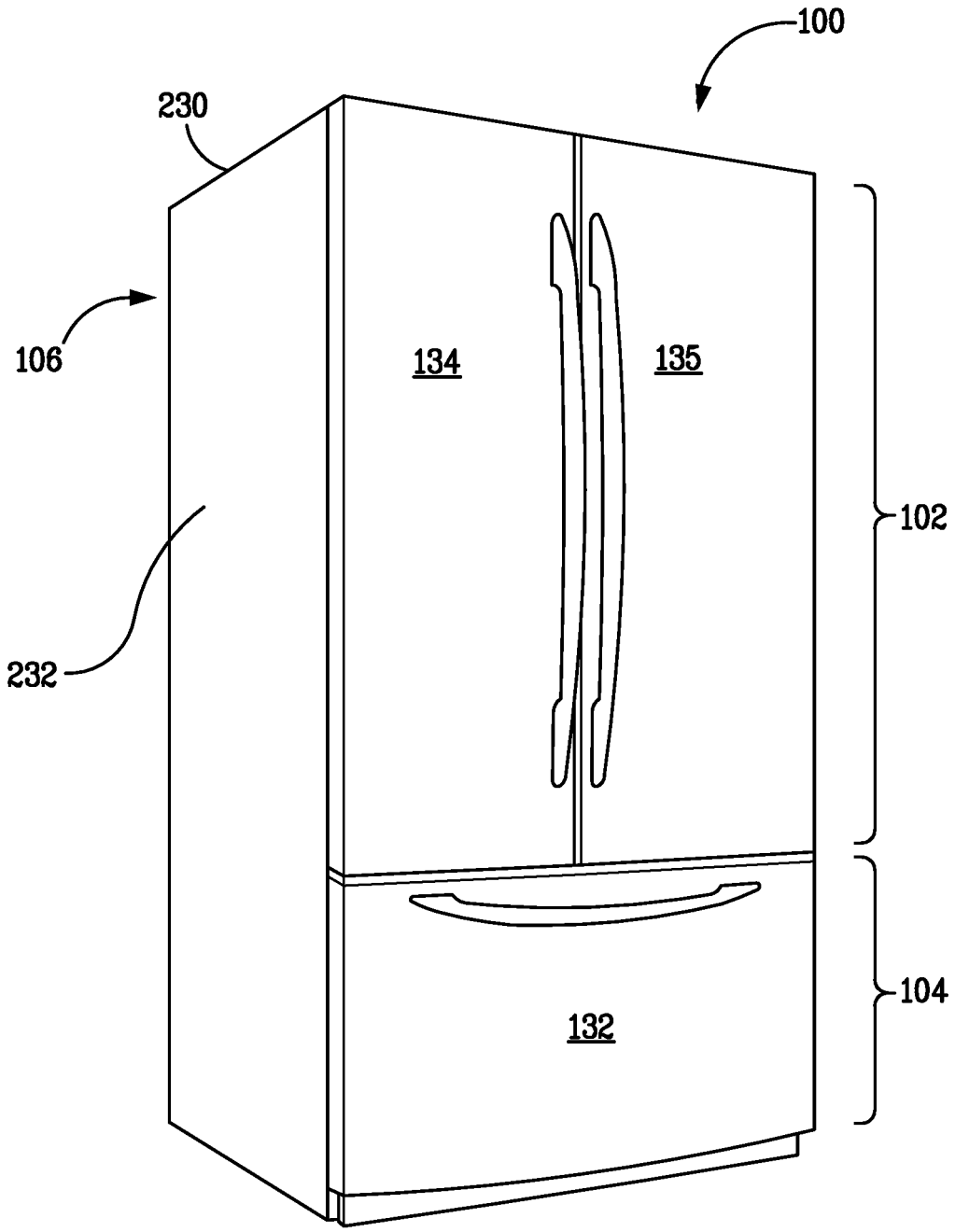
FIG. 1 is a perspective view of a known refrigerator.
Figure 2:
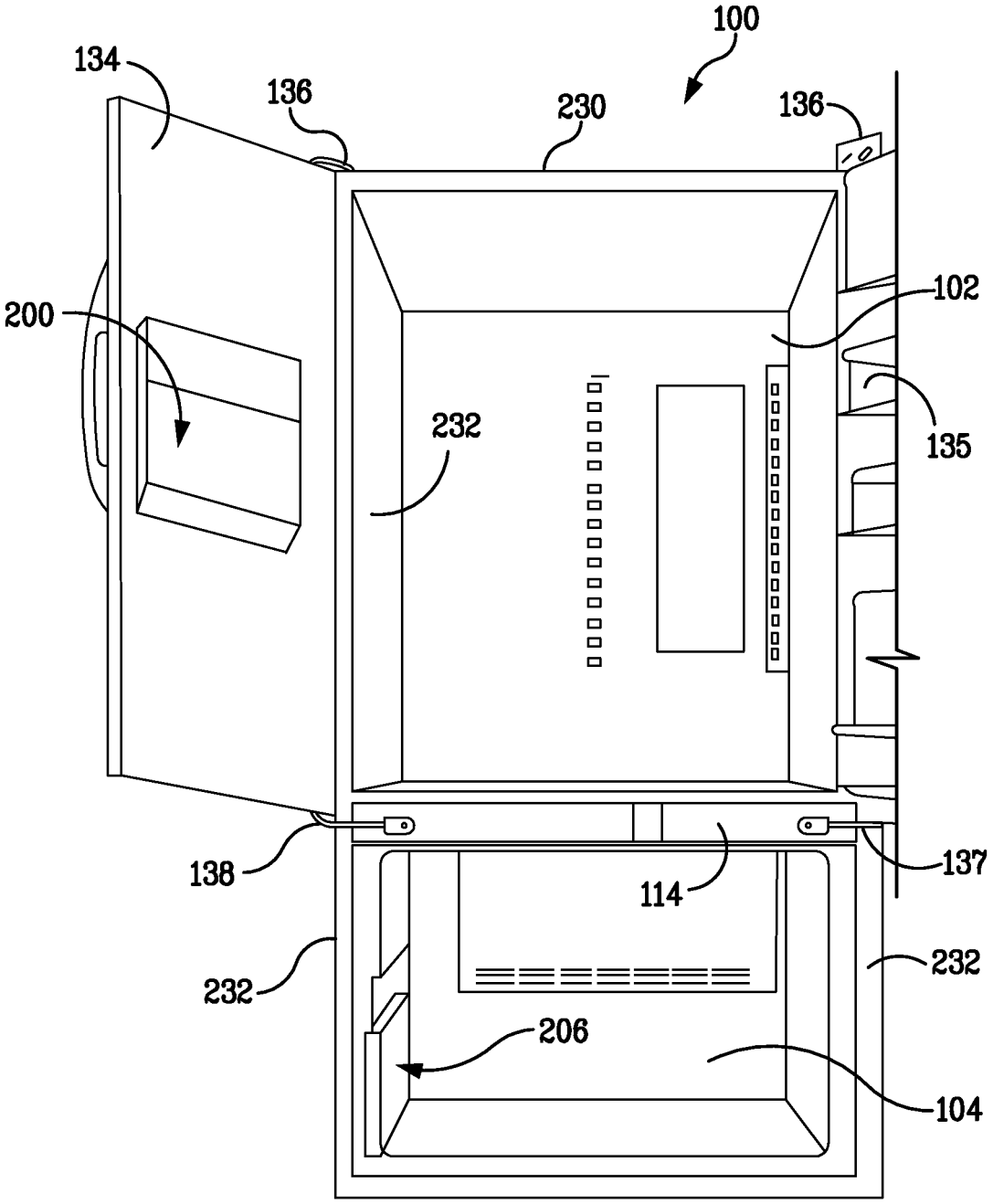
FIG. 2 is a perspective view of the refrigerator of FIG. 1 with the refrigerator doors open.

FIGS. 1 and 2 illustrate a side-by-side refrigerator 100 including a fresh food compartment 102 and freezer compartment 104. Freezer compartment 104 and fresh food compartment 102 are arranged in a bottom mount configuration where the freezer compartment 104 is below the fresh food compartment 102. The fresh food compartment is shown with French opening doors 134 and 135. However, a single door may be used. Door or drawer 132 closes freezer compartment 104.

The fresh food compartment 102 and freezer compartment 104 are contained within an outer case 106. Outer case 106 normally is formed by folding a sheet of a suitable material, such as pre-painted steel, into an inverted U-shape to form top and sidewalls 230, 232 of case 106. Mullion 114 is preferably formed of an extruded ABS material. As shown in FIG. 2, Mullion 114 separates the fresh food compartment 102 and the freezer compartment 104.

Door 132 and doors 134, 135 close access openings to freezer and fresh food compartments 104, 102, respectively. Each door 134 and 135 is mounted by a top hinge 136 and a bottom hinge 137 to rotate about its outer vertically oriented edge between an open position, as shown in FIG. 2, and a closed position shown in FIG. 1 closing the associated storage compartment.

In accordance with known refrigerators, refrigerator 100 also includes a machinery compartment (not shown) that at least partially contains components for executing a known vapor compression cycle for cooling air in the compartments. The components include a compressor (shown schematically in FIG. 3 as 151), a condenser (shown schematically in FIG. 3 as 152), an expansion device (shown schematically in FIG. 3 as 155), and an evaporator (shown schematically in FIG. 3 as 156) connected in series and charged with a refrigerant. The evaporator is a type of heat exchanger that transfers heat from air passing over the evaporator to a refrigerant flowing through the evaporator, thereby causing the refrigerant to vaporize. The cooled air is used to refrigerate one or more fresh food or freezer compartments via fans (shown schematically in FIG. 3 as 157). Collectively, the vapor compression cycle components in a refrigeration circuit, associated fans, and associated compartments are referred to herein as a sealed system. The construction of the sealed system is well known and therefore not described in detail herein, and the sealed system is operable to force cold air through the refrigerator 100.

The secondary loop temperature control circuit or distributed temperature system of the present invention may be used for a variety of distributed temperature control applications where localized temperature control is desired. These applications may including more than one temperature controlled compartments or regions that may be zoned with valves or other mechanisms.

Figure 3:
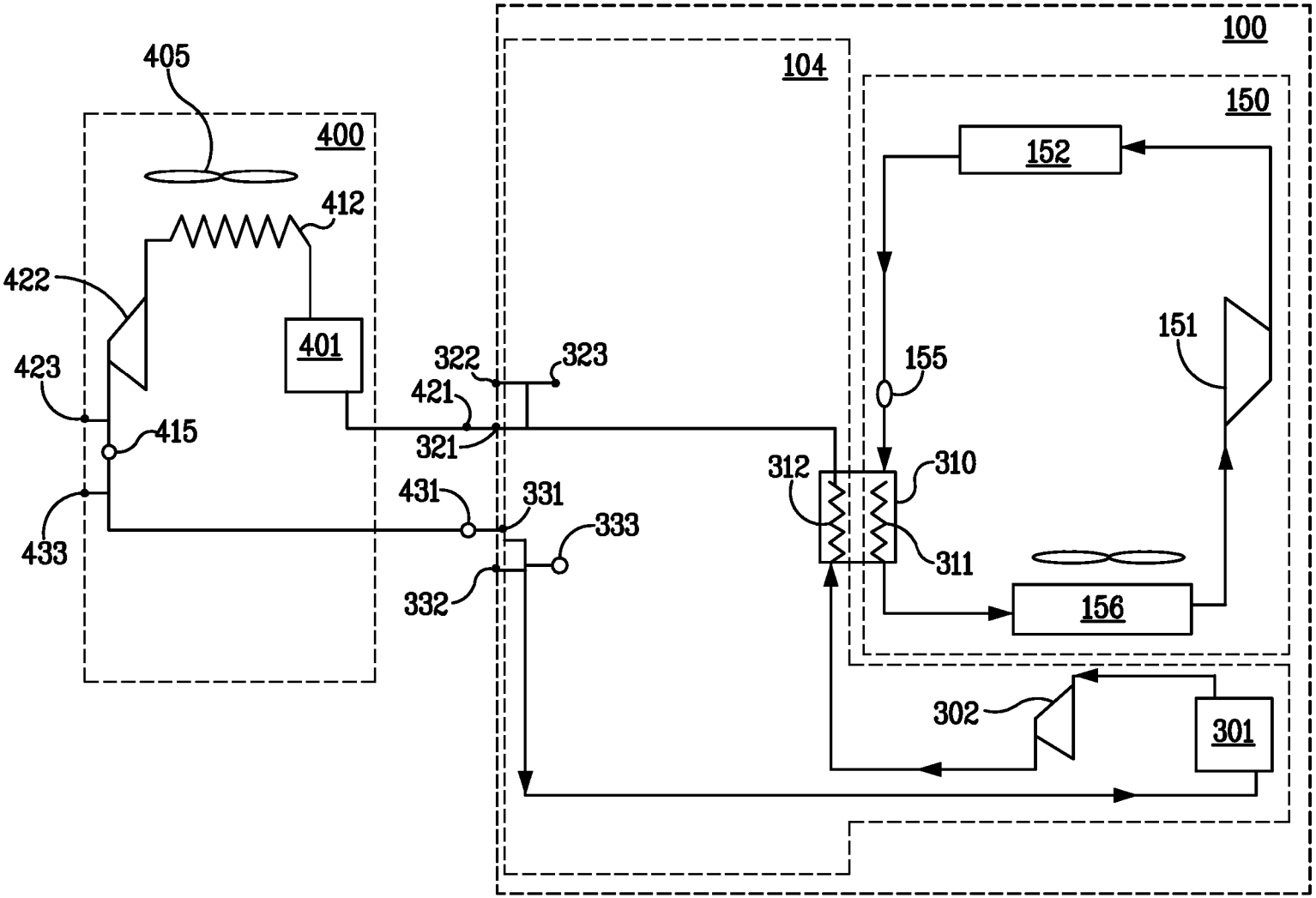
FIG. 3 is a schematic view of an embodiment of the invention.

FIG. 3 is a schematic view of an embodiment of the invention. The refrigerator 100 contains a temperature control circuit, the temperature control circuit is a vapor-compression circuit 150, which is known in the art. The vapor compression circuit 150 has a compressor 151 for compressing a working fluid. When compressed the working fluid becomes heated, heat is removed in coil 152. The working fluid is decompressed or vaporized at 155 thereby further cooling the working fluid. The working fluid passes through medium heat exchanger 310 before entering evaporator 156. Evaporator 156 may have a fan 157 to circulate air from freezer compartment 104 in a plenum (not shown) past evaporator 156 and back to freezer compartment 104 thereby cooling freezer compartment 104.

As shown in FIG. 3, heat exchanger 310 thermally connects the vapor-compression circuit 150 with the distributed temperature system of the present invention. However, heat exchanger 310 may not be directly connected to the vapor compression circuit 150 and may utilize heat transfer to the freezer compartment 104 as a means of cooling the working medium in the distributed temperature system. It can be appreciated that by locating the heat exchanger 310 between compressor 151 and the coil 152, heat may be transferred to the working medium of the distributed temperature system of the invention.

The distributed temperature system utilizes a working medium, hereinafter "medium". The medium is preferably a food safe medium, such as propylene glycol. The working medium flows in tubes or conduits connecting the components of the system.

Heat exchanger 310 has a coil 311 as a part of the vapor compression circuit 150 and a coil 312 as a part of the distributed temperature system. The coils 311 and 312 are in thermal communication generally by a working fluid thereby transferring heat from one system to the other. It can be appreciated that coil 312 may be removed and the medium may flow around coil 311 thereby transferring heat directly to the medium.

Tank 301 of the distributed temperature system allows a quantity of the medium to be maintained in the system. The tank 301 may contain a means for adding additional medium to the distributed temperature system.

Pump 302 moves the medium from tank 301 past or through heat exchanger 310 to output ports 321, 322 and 323. Output ports 321 and 322 are provided in an exterior surface of the refrigerator 100. It can be appreciated that any number of output ports 321, 322 can be provided in the exterior of refrigerator 100. Output port 323 is provided on the interior of the refrigerator 100. It can be appreciated that while only one output port 323 is shown in the freezer compartment 104 of refrigerator 100, multiple output ports may be provided in either the freezer compartment 104 or fresh food compartment 102 of refrigerator 100.

Similarly input ports 331 and 332 are also provided in an exterior surface of the refrigerator 100. It can be appreciated that any number of input ports 331, 332 can be provided in the exterior of refrigerator 100. Input port 333 is provided on the interior of the refrigerator 100. It can be appreciated that while only one input port 323 is shown in the freezer compartment 104 of refrigerator 100, multiple input ports may be provided in either the freezer compartment 104 or fresh food compartment 102 of refrigerator 100.

By providing multiple output ports 321, 322, 323 and multiple input ports 331, 332, 333 multiple devices 400 may be connected to the distributed temperature system in parallel. By connecting the devices 400 in parallel each device 400 receives medium directly from heat exchanger 310. In this configuration each device 400 receives medium of similar temperature.

Output ports 321, 322, 323 and input ports 331, 332, 333 are configured such that when no device is connected, flow through the disconnected port is prevented. One such configuration used to achieve this functionality, comprises a hydraulic quick disconnect with an internal valve, however, any interconnect may be used which prevents leakage of the medium when the port is not used.

Device 400 is connected to the distributed temperature system by similar quick disconnects at device input port 421 and device output port 431. Medium flows into the device 400 to a tank 401. Tank 401 may contain a volume of storage or may be a means of removing air from the device 400.

Device heat exchanger 412 thermally connects the medium to the device 400. Generally, heat is transferred by conduction between the heat exchanger 412 and device 400. However, a fan 405 may be used to accelerate the transfer of heat between the device heat exchanger 412 and the device 400 in combination with convection heat exchange within device 400. Further, a device pump 402 may be incorporated in the device 400 to facilitate flow of the medium.

Device 400 may also include an auxiliary output port 423 and auxiliary input port 433. Auxiliary ports 423 and 433 permit the connection of additional devices serially with device 400.

While the invention is described with reference to a vapor compression loop of a refrigerator, it is understood that any means of transferring heat to or from the medium within the heat exchanger of the secondary loop cooling circuit of the invention may be used. Further, the distributed temperature system may comprise a pair of circuits offering both a cooling circuit and a heating circuit.

Output ports 321, 322 and 323 or input ports 331, 332 and 333 may incorporate an electrical interconnect. The electrical interconnect being designed to facilitate communications between the device 400 and components of the distributed temperature system. Such communications may include a pump signal to activate pump 302, a temperature signal indicating a temperature of the device 400.

Device 400 may be any household device that must be kept at a temperature other then the ambient temperature within the house. Devices include a surface such a chilled surface to hold vegetable trays or for working with food or a heated surface for keeping foods or other items warm. Other devices include a stand-alone ice-maker or ice holder, a fast chill compartment, a chiller or heater for drinking water supply, a soda or beer (keg-orator) chiller, a dehumidifier heating or cooling side. Further applications for a distributed temperature system include a compartment for thawing food, a wine chiller, a glass chiller for frosted mugs/glasses or to quick chill a portable cooling device such as a cold pack or a cooler.

While the invention has been described in terms of various specific embodiments, those skilled in the art will recognize that the invention can be practiced with modification within the spirit and scope of the claims.

The invention claimed is:

1. A refrigerator comprising:

a food storage compartment;

a first temperature control circuit for directly cooling the food storage compartment, the first temperature control circuit comprising a vapor-compression circuit comprising an expansion device and a first heat exchanger disposed downstream of the expansion device;

a second temperature control circuit comprising:

a food safe working liquid medium;

a second heat exchanger in thermal communication with the first heat exchanger and configured to have the food safe working liquid medium flow therethrough to decrease a temperature of the liquid medium;

a first output quick disconnect port provided in a surface of the refrigerator and in flow communication with a supply side of the second heat exchanger; and a first input quick disconnect port provided in the surface of the refrigerator and in flow communication with a return side of the second heat exchanger; and a first temperature controlled device including a liquid circulation circuit comprising a device input port for receiving the liquid medium from the second temperature control circuit and a device output port for returning the liquid medium to the second temperature control circuit wherein the second temperature control circuit is removably connectable to the first temperature controlled device through a functional coupling and decoupling of the first output quick disconnect port and the device input port of the first temperature controlled device and a functional coupling and decoupling of the first input quick disconnect port and the device output port of the first temperature controlled device.

2. The refrigerator of claim 1, wherein the second temperature control circuit further comprises a second output quick disconnect port for providing the liquid medium to a second temperature controlled device, and a second input quick disconnect port for receiving the liquid medium from the second temperature controlled device, the second output quick disconnect port and the second input quick disconnect port being in parallel fluid communication with the first output quick disconnect port and the first input quick disconnect port.

3. The refrigerator of claim 1, wherein the food storage compartment is a freezer compartment, and the second heat exchanger is a medium tank disposed in the freezer compartment.

4. The refrigerator of claim 1, wherein the second temperature control circuit further comprises a medium storage tank in flow communication with the second heat exchanger.

5. The refrigerator of claim 4, wherein the second temperature control circuit further comprises a pump in flow communication with the second heat exchanger.

6. The refrigerator of claim 1, wherein the first temperature control circuit is a sealed vapor compression circuit.

7. The refrigerator of claim 1, wherein the food storage compartment is a freezer compartment.

8. The refrigerator of claim 1, wherein the first output quick disconnect port and the first input quick disconnect port comprise a hydraulic quick disconnect device with an internal valve.

9. An appliance comprising:

a food storage compartment;

a first temperature control circuit for directly cooling the food storage compartment, the first temperature control circuit comprising a vapor-compression circuit comprising an expansion device and a first heat exchanger disposed downstream of the expansion device;

a first temperature controlled device; and a second temperature control circuit for cooling the first temperature controlled device, the second temperature control circuit comprising:

a food safe working liquid medium;

a second heat exchanger in thermal communication with the first heat exchanger and configured to have the food safe working liquid medium flow therethrough to decrease a temperature of the liquid medium;

a first output quick disconnect port provided in a surface of the appliance and in flow communication with a supply side of the second heat exchanger; and a first input quick disconnect port provided in the surface of the appliance and in flow communication with a return side of the second heat exchanger, and wherein the first temperature controlled device comprises a device input port that is configured to be functionally connected to and disconnected from the first output quick disconnect port of the second temperature control circuit and a device output port that is configured to be functionally connected to and disconnected from the first input quick disconnect port of the second temperature control circuit.

10. The appliance of claim 9, wherein the second temperature control circuit further comprises a medium storage tank in flow communication with the second heat exchanger.

11. The appliance of claim 10, wherein the first temperature controlled device further comprises a third temperature control circuit comprising a third heat exchanger in flow communication with the second heat exchanger through the first output quick disconnect port and the first input quick disconnect port, and a second medium storage tank in flow communication with the third heat exchanger.

12. The appliance of claim 11, wherein the second temperature control circuit further comprises a pump for circulating the liquid medium through the second temperature control circuit, the third temperature control circuit further comprising a second pump for circulating the liquid medium through the third temperature control circuit.

13. The appliance of claim 9, wherein the food storage compartment is a freezer compartment, the second heat exchanger being a medium storage tank disposed in the freezer compartment.

14. The appliance of claim 9, wherein the first output quick disconnect port provides the liquid medium to the first temperature controlled device, and the first input quick disconnect port receives the liquid medium from the first temperature controlled device.

15. The appliance of claim 14, further comprising a second output quick disconnect port for providing the liquid medium to a second temperature controlled device, and a second input quick disconnect port for receiving the liquid medium from the second temperature controlled device.

16. The appliance of claim 9, wherein the first temperature control circuit is a sealed vapor compression circuit comprising an expansion device and an evaporator, the first heat exchanger being disposed between the expansion device and the evaporator.

17. The appliance of claim 16, wherein the first heat exchanger and the second heat exchanger are coils that are in a direct thermal coupling relationship.

18. The appliance of claim 9, wherein the second temperature control circuit further comprises a second output quick disconnect port provided in the surface of the appliance and in flow communication with the supply side of the second heat exchanger and a second input quick disconnect port provided in the surface of the appliance and in flow communication with the return side of the second heat exchanger.

19. The appliance of claim 9, wherein each of the first output quick disconnect port and the first input quick disconnect port comprises a hydraulic quick disconnect device with an internal valve for removably connecting and disconnecting the first temperature controlled device to the second temperature control circuit.

20. The appliance of claim 9, wherein the second temperature control circuit further comprises an electrical interconnect switch in the first output quick disconnect port and the first input quick disconnect port, the electrical interconnect switch being electrically coupled to a pump to cause the pump to activate when the first temperature controlled device is removably connected to the first output quick disconnect port and the first input quick disconnect port.

* * * * *